US011781223B2

(12) United States Patent
Schuette et al.

(10) Patent No.: US 11,781,223 B2
(45) Date of Patent: Oct. 10, 2023

(54) REPAIR COATING AND METHOD FOR REPAIRING A DAMAGED PORTION OF A STEEL MEMBER

(71) Applicant: The Boeing Company, Chicago, IL (US)

(72) Inventors: Waynie M. Schuette, Troy, IL (US); Marc J. Froning, Seattle, WA (US); Stephen P. Gaydos, St. Louis, MO (US)

(73) Assignee: The Boeing Company, Arlington, VA (US)

( * ) Notice: Subject to any disclaimer, the term of this patent is extended or adjusted under 35 U.S.C. 154(b) by 0 days.

(21) Appl. No.: 17/678,190

(22) Filed: Feb. 23, 2022

(65) Prior Publication Data

US 2022/0403527 A1 Dec. 22, 2022

Related U.S. Application Data

(60) Provisional application No. 63/211,052, filed on Jun. 16, 2021.

(51) Int. Cl.
*C23C 24/08* (2006.01)
*C22C 27/06* (2006.01)

(52) U.S. Cl.
CPC ..... *C23C 24/087* (2013.01); *C22C 27/06* (2013.01)

(58) Field of Classification Search
CPC ..... C23C 24/087; C22C 27/06
See application file for complete search history.

(56) References Cited

U.S. PATENT DOCUMENTS

| | | | | |
|---|---|---|---|---|
| 10,837,088 | B2 | 11/2020 | Kathrein et al. | |
| 2009/0053423 | A1* | 2/2009 | Freti | C23C 30/005 427/419.7 |
| 2011/0312860 | A1* | 12/2011 | Mathew | C23C 4/067 508/150 |
| 2013/0015074 | A1* | 1/2013 | Gaydos | C25D 5/67 205/115 |
| 2014/0115854 | A1* | 5/2014 | Widener | C23C 24/04 29/402.18 |
| 2017/0122392 | A1* | 5/2017 | Lembach | F16D 69/04 |
| 2017/0175570 | A1* | 6/2017 | Calla | F01D 25/005 |
| 2017/0335442 | A1* | 11/2017 | Brupbacher | C23C 8/20 |
| 2018/0156758 | A1* | 6/2018 | Glass, III | G01N 29/28 |
| 2018/0258539 | A1* | 9/2018 | Wilson | C23C 24/04 |
| 2022/0356583 | A1* | 11/2022 | Brown | C23C 28/021 |

OTHER PUBLICATIONS

Assadi et al. "On Parameter Selection in Cold Spraying". Journal of Thermal Spray Technology 20, 1161-1176 (2011). (Year: 2011).*
Hoganas, "Powders for Thermal Spraying," No. PD-4036, Issue 7-12.04.2018. https://www.hoganas.com/globalassets/download-media/stc/pd-4036.pdf.

* cited by examiner

*Primary Examiner* — Alexander M Weddle
(74) *Attorney, Agent, or Firm* — Walters & Wasylyna LLC

(57) ABSTRACT

A method for repairing a damaged portion of a steel member that includes at least one of a coating and a plating. The method includes applying to the damaged portion of the steel member a coating composition to produce a repair coating. The coating composition includes nickel, chromium, and carbon.

20 Claims, 8 Drawing Sheets

REPAIR COATING AND METHOD FOR REPAIRING A DAMAGED PORTION OF A STEEL MEMBER

PRIORITY

This application claims priority from U.S. Ser. No. 63/211,052 filed on Jun. 16, 2021.

FIELD

This application relates to the repair of steel members that include a coating and/or plating, such as high velocity oxygen fuel coated steel members, nickel plated steel members, and chrome plated steel members.

BACKGROUND

Coated steel members (e.g., high velocity oxygen fuel (HVOF) coated steel members) and plated steel materials (e.g., nickel plated steel members and chrome plated steel members) are commonly used in aerospace applications. Options for repairing damaged (e.g., cosmetically damaged) steel members having a coating and/or plating are limited, and yield poor adhesion properties, particularly for chrome plated steel members, high velocity oxygen fuel coated steel members, and nickel plated steel members. Removing and replacing the entire coating and/or plating on a steel member is expensive and time-consuming. Thus, challenges arise when steel members having a coating and/or plating are subjected to significant wear and become damaged.

Accordingly, those skilled in the art continue with research and development efforts in the field of repairing steel members having a coating and/or plating.

SUMMARY

Disclosed are methods for repairing a damaged portion of a steel member that includes at least one of a coating and a plating.

In one example, the method for repairing a damaged portion of a steel member that includes at least one of a coating and a plating includes applying to the damaged portion of the steel member a coating composition to produce a repair coating. The coating composition includes nickel, chromium, and carbon.

Also disclosed are repair coatings for a damaged portion of an aerospace component.

In one example, the repair coating for a damaged portion of an aerospace component includes a coating composition. The coating composition includes nickel, chromium, and carbon.

Other examples of the disclosed repair coatings and methods for repairing a damaged portion of a steel member that includes at least one of a coating and a plating will become apparent from the following detailed description, the accompanying drawings, and the appended claims.

BRIEF DESCRIPTION OF THE DRAWINGS

Some examples of the present disclosure are described with reference to the accompanying drawings. The same reference number represents the same element or the same type of element on all drawings.

DETAILED DESCRIPTION

Figure 1:
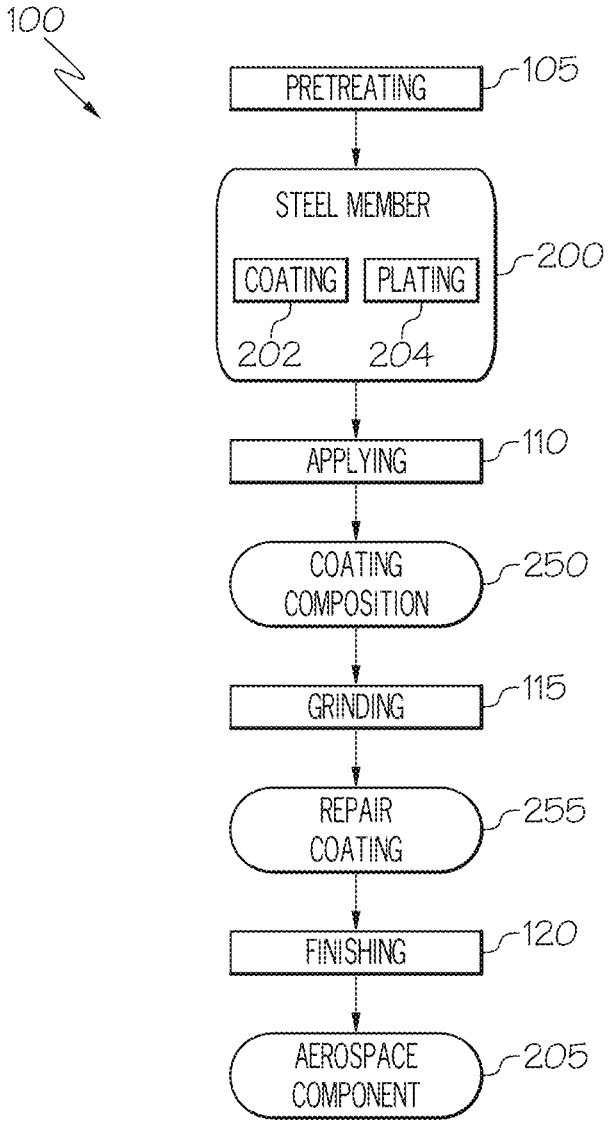
FIG. 1 is a flowchart of a method for repairing a damaged portion of a steel member that includes at least one of a coating and a plating.

The following detailed description refers to the accompanying drawings, which illustrate specific examples described by the present disclosure. Other examples having different structures and operations do not depart from the scope of the present disclosure. Like reference numerals may refer to the same feature, element, or component in the different drawings.

Illustrative, non-exhaustive examples, which may be, but are not necessarily, claimed, of the subject matter according to the present disclosure are provided below. Reference herein to "example" means that one or more feature, structure, element, component, characteristic, and/or operational step described in connection with the example is included in at least one aspect, embodiment, and/or implementation of the subject matter according to the present disclosure. Thus, the phrases "an example," "another example," "one or more examples," and similar language throughout the present disclosure may, but do not necessarily, refer to the same example. Further, the subject matter characterizing any one example may, but does not necessarily, include the subject matter characterizing any other example. Moreover, the subject matter characterizing any one example may be, but is not necessarily, combined with the subject matter characterizing any other example.

Referring to FIG. 1, disclosed is a method 100 for repairing a damaged portion of a steel member 200 that includes at least one of a coating 202 and a plating 204. The damaged portion may be (or may include) cosmetic damage to at least a portion of the coating 202 and/or the plating 204 on the steel member 200. Repairing other types of (e.g., non-cosmetic) damage is also contemplated.

Various steel members 200 that include a coating 202 and/or a plating 204 may benefit from the disclosed method 100 and, therefore, may be used without departing from the scope of the present disclosure. For example, but without limitation, the steel member 200 may be (or may include) 4130 steel, a mild steel, a 4xxx-series steel, or a combination thereof.

Various coatings 202 and/or platings 204 may be used on the steel member 200 without departing from the scope of the present disclosure. In one particular example, the steel member 200 may be a high velocity oxygen fuel (HVOF) coated steel member, such tungsten carbide, cobalt or chromium HVOF steel member. In another example, the steel member 200 may be a nickel plated steel member. In another example, the steel member 200 may be a chrome plated steel member. In yet another example, the steel member 200 may include a combination of coatings and/or platings.

The method 100 may include pretreating 105 the damaged portion of the steel member 200 with an abrasive media prior to the applying 110 (discussed below). In one example, the pretreating 105 includes sand blasting the damaged portion of the steel member 200. In another example, the pretreating 105 includes grinding the damaged portion of the steel member 200. In yet another example, the pretreating 105 includes grit blasting the damaged portion of the steel member 200.

Still referring to FIG. 1, the method 100 further includes applying 110 to the damaged portion of the steel member 200 a coating composition 250 to produce a repair coating 255.

Various techniques may be used for the applying 110 without departing from the scope of the present disclosure. In one particular example, the applying 110 includes cold spraying the coating composition 250. The applying 110 may include using a carrier gas at a temperature of approximately 400° C. to approximately 800° C. In another example, the applying 110 includes using a carrier gas at a temperature of approximately 500° C. to approximately 700° C. The carrier gas may include nitrogen, helium, or a combination of nitrogen and helium. The applying 110 may be performed at a stagnation gas pressure of approximately 300 psi to approximately 700 psi.

The coating composition 250 includes nickel, chromium, and carbon, and may be in the form of a powder. In one example, the coating composition 250 includes CrC—NiCr. In another example, the coating composition 250 includes $Cr_3C_2$—NiCr. The $Cr_3C_2$—NiCr powder may be AMPERIT 587.072 by Höganäs of Höganäs, Sweden. In another example, the coating composition 250 is nominally 75 percent (by weight) CrC and 25 percent (by weight) NiCr. In yet another example, the coating composition 250 includes $Cr_3C_2$—Ni. The coating composition 250 may include a combination of one or more CrC—NiCr and $Cr_3C_2$—Ni compositions.

In one example, the applying 110 includes applying 110 a powder of the coating composition 250. The applying 110 may be performed at a powder feed rate of approximately 5 g/min to approximately 25 g/min. In another example, the applying 110 includes applying 110 the coating composition 250 at a powder feed rate of approximately 10 g/min to approximately 20 g/min. The powder feed rate may further be characterized as approximately 4 RPM to approximately 8 RPM. Further, the applying 110 may be performed at a spray angle of approximately 90 degrees.

The applying 110 may be performed to achieve a desired nominal cross-sectional thickness (i.e., coating thickness) of the repair coating 255. For example, the nominal cross-sectional thickness of the repair coating 255 may range from about 1 mil to about 15 mils, or from about 2 mils to about 12 mils, or from about 3 mils to about 10 mils, wherein 1 mil equals 0.001 inch.

Referring to FIG. 1, the method 100 may further include grinding 115 the damaged portion of the steel member 200 after the applying 110. The parameters for grinding 115 are determined by surface finish requirements. In one example, the grinding 115 includes grinding 115 at 320 grit before 600 and 1200 grits.

Referring to FIG. 1, the method 100 may further include finishing 120 the damaged portion of the steel member 200 after the applying. Depending on the surface finish requirements, the finishing 120 may include super-finishing.

Also disclosed is a repair coating 255 for a damaged portion of an aerospace component 205. The repair coating 255 includes a coating composition 250. The coating composition 250 includes nickel, chromium, and carbon, and may be in the form of a powder. In one particular example, the coating composition 250 may include CrC—NiCr. In another example, the coating composition 250 may include $Cr_3C_2$—NiCr. In yet another example, the coating composition 250 may include $Cr_3C_2$—Ni.

In one example, the hardness of the repair coating 255 is substantially the same (i.e., within ±2 percent) as a hardness of the aerospace component 205. In one particular example, the Vickers hardness of the repair coating 255 may be at least 500 HV0.1. In another example, the Vickers hardness of the repair coating 255 may be at least 600 HV0.1. In yet another example, the Vickers hardness of the repair coating 255 may range from about 600 HV0.1 to about 800 HV0.1.

The aerospace component 205 may include high velocity oxygen fuel coated steel, nickel plated steel, chrome plated steel, or a combination thereof. In another example, the aerospace component 205 may include any hard wear coating.

Deposition efficiency of the repair coating is the ratio of the amount of powder particles that adhere to the aerospace component 205 versus the amount of powder particles that are sprayed on the aerospace component 205. In one example, the deposition efficiency of the repair coating 255 is at least 2 percent. In another example, the deposition efficiency of the repair coating 255 is at least 3 percent. In yet another example, the deposition efficiency of the repair coating 255 is about 4 percent.

Figure 8:
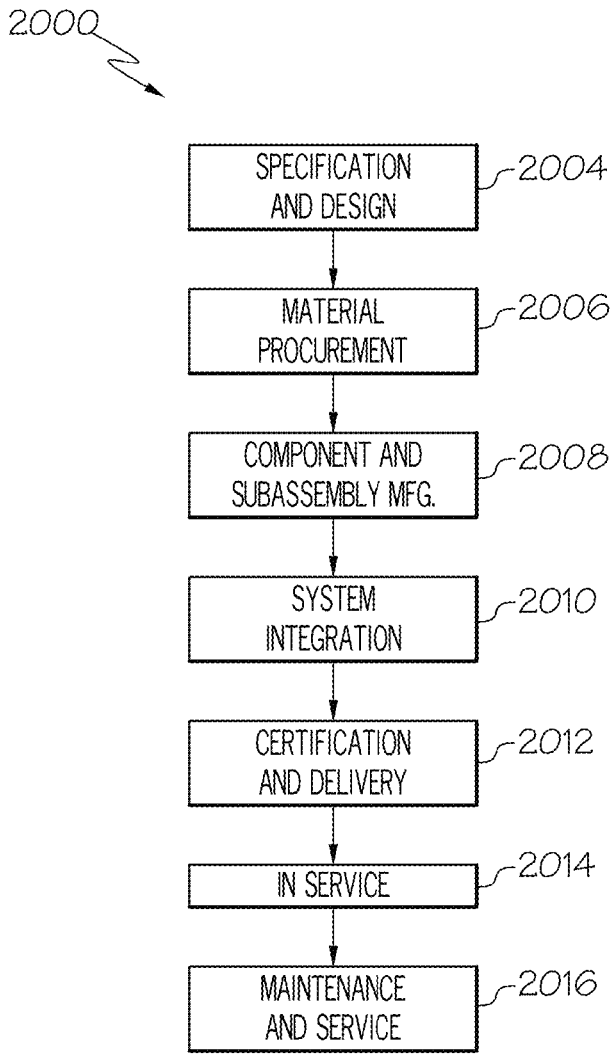
FIG. 8 is a block diagram of aircraft production and service methodology.
Figure 9:
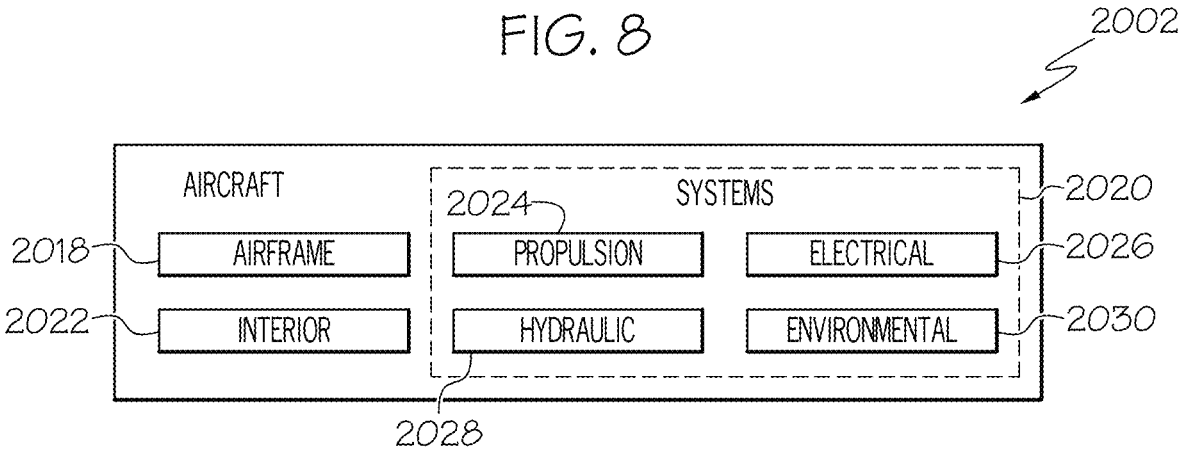
FIG. 9 is a schematic illustration of an aircraft.

Examples of the disclosure may be described in the context of an aircraft manufacturing and service method 2000, as shown in FIG. 8, and an aircraft 2002, as shown in FIG. 9. During pre-production, the aircraft manufacturing and service method 2000 may include specification and design 2004 of the aircraft 2002 and material procurement 2006. During production, component/subassembly manufacturing 2008 and system integration 2010 of the aircraft 2002 takes place. Thereafter, the aircraft 2002 may go through certification and delivery 2012 in order to be placed in service 2014. While in service by a customer, the aircraft 2002 is scheduled for routine maintenance and service 2016, which may also include modification, reconfiguration, refurbishment, and the like.

Each of the processes of method 2000 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, and so on.

As shown in FIG. 9, the aircraft 2002 produced by example method 2000 may include an airframe 2018 with a plurality of systems 2020 and an interior 2022. Examples of the plurality of systems 2020 may include one or more of a propulsion system 2024, an electrical system 2026, a hydraulic system 2028, and an environmental system 2030. Any number of other systems may be included.

The disclosed repair coatings and methods for repairing a damaged portion of a steel member that includes at least one of a coating and a plating may be employed during any one or more of the stages of the aircraft manufacturing and service method 2000. As one example, the disclosed repair coatings and methods for repairing a damaged portion of a steel member that includes at least one of a coating and a plating may be employed during material procurement 2006. As another example, components or subassemblies corresponding to component/subassembly manufacturing 2008, system integration 2010, and or maintenance and service 2016 may be fabricated or manufactured using the disclosed repair coatings and methods for repairing a damaged portion of a steel member that includes at least one of a coating and a plating. As another example, the airframe 2018 and the interior 2022 may be constructed using the disclosed repair coatings and methods for repairing a damaged portion of a steel member that includes at least one of a coating and a plating. Also, one or more apparatus examples, method examples, or a combination thereof may be utilized during component/subassembly manufacturing 2008 and/or system integration 2010, for example, by substantially expediting assembly of or reducing the cost of an aircraft 2002, such as the airframe 2018 and/or the interior 2022. Similarly, one or more system examples, method examples, or a combination thereof may be utilized while the aircraft 2002 is in service, for example and without limitation, to maintenance and service 2016.

The disclosed repair coatings and methods for repairing a damaged portion of a steel member that includes at least one of a coating and a plating are described in the context of an aircraft. However, one of ordinary skill in the art will readily recognize that the disclosed repair coatings and methods for repairing a damaged portion of a steel member that includes at least one of a coating and a plating may be utilized for a variety of applications. For example, the disclosed repair coatings and methods for repairing a damaged portion of a steel member that includes at least one of a coating and a plating may be implemented in various types of vehicles including, e.g., helicopters, watercraft, passenger ships, automobiles, and the like.

EXAMPLES

The disclosed repair coatings and methods for repairing a damaged portion of a steel member that includes at least one of a coating and a plating were tested for material properties. The objective of the examples includes identification of the ideal combination of processing parameters for producing cold sprayed (CS) $Cr_3C_2$—NiCr depositions with low porosity and high interface quality and good substrate adhesion using primarily nitrogen gas at supersonic speeds for repair applications using a high pressure cold Spray system (HPCS). While nitrogen gas ($N_2$) was primarily used, hydrogen gas ($H_2$), air, and combinations of gases (at various ratios) were also contemplated.

A VRC Gen-III HPCS system was employed for producing the depositions. For the sprays, a de Laval tungsten—carbide (WC) nozzle of the following geometrical dimensions was utilized: (1) 2 mm throat diameter; (2) 6.3 mm exit diameter; and (3) 200 mm length. This combination of throat and exit diameters was chosen due to the high degree of gas expansion and high gas velocities possible with nitrogen gas using such a setup. In some comparison experiments using helium gas or helium/nitrogen gas mixtures, a polymeric, PBI, nozzle was used which was: (1) 2 mm throat diameter; (2) 4 mm exit diameter; and (3) 120 mm length.

Nitrogen/helium gas at high pressures (~1800-2200 psi and stored in gas cylinders) was supplied to the VRC system which was then regulated to the chosen gas pressure using a pressure regulator. The pressurized gas was measured for flow rates and thereby split in to two paths: (1) Path connecting the heater (processing gas) and (2) Path connecting the powder feeder (carrier gas). The processing gas was heated to the set gas temperature via the heater and, when the desired temperature was reached, the powder particles were introduced into the carrier gas stream by a powder feeder just prior to entering the nozzle. The powder feeder had 80 holes with a total volume of (feed volume) 0.637 cc. Both the carrier gas and processing gas were mixed in a device (i.e., applicator) which was connected directly in front of the de Laval nozzle. The de Laval nozzle expands the gas mixture to velocities ~2-3 Mach number in front of the substrate. The fine (10-40 micron) metallic particles are accelerated by this gas stream to velocities typically in the range of 600-1200 m/s. Consequently, the powder particles severely plastically deform upon impacting the substrate and form a metallurgical bond.

$Cr_3C_2$—NiCr powder (AMPERIT 587.072) from Höganäs was used. A total of 25 test coupons were produced using three $Cr_3C_2$—NiCr (CrCNi) powders and investigated.

Methods to mix gases were explored. Individual cylinders of helium and nitrogen were purchased and the number of cylinders of each gas combined into a single, high-pressure manifold was varied. After considering the dimensions of each test sample (1 in by 1 in) and the spray parameters, six cylinders in total were finalized to be sufficient for each experiment. Three He:$N_2$ ratios were investigated: (1) 50:50; (2) 67:33; and (3) 33:67 by volume. Accordingly, the number of He and $N_2$ cylinders were selected and connected together using a manifold. The outlet of the manifold was connected to the nitrogen inlet of the VRC system. The efficacy of this approach was checked using two experiments on CP titanium depositions (volume mixtures of 50:50 and 33:67). The pressures of the individual gas cylinders before and after cold spray deposition were measured. The differences in the pressure of individual gases cylinders were determined to be consistent with the predicted mass fractions of gas consumed during the spray (i.e., following the ideal gas law).

Various cold spray parameters were investigated and optimized during experimentation: powder feed rate (powder feeder rpm); powder feed flow rate; nozzle velocity; stagnation gas temperature; and stagnation gas pressure. All five spray parameters were investigated and optimized for $Cr_3C_2$—NiCr cold spray depositions.

Optical (Nikon) and scanning electron microscopy (SEM) (Tescan Lyra) in the back scatter electron mode were used to characterize the as-received powder morphology, cross-sectional powder microstructure, and microstructure of cross-sectional cold spray depositions. As-received powder morphology characterization was conducted by adhering the powder particles on carbon tape and then performing SEM. For cross-sectional powder sample preparation, powder particles were hot mounted in graphite filled Bakelite and ground on fine SiC grit sand papers (600 and 1200 grit). Subsequently, they were subjected to coarse and fine diamond polishing (9 μm, 6 μm, and 1 μm). Finally, very fine polishing using a combination of either colloidal silica/$H_2O_2$ on a chemical pad or 0.05 μm alumina on high-napped flock pad was employed. The former was used for CP titanium/

Ti-6Al-4V powder/cold spray depositions, whereas the latter was utilized for $Cr_3C_2$—NiCr powder/cold spray depositions. Cross-sectional cold spray sample preparation involved sectioning the cold spray depositions along the raster direction using an abrasive saw. The cross-sectional cold spray depositions were then hot mounted and prepared using the above-listed procedures, albeit with an addition in the grinding steps (i.e., grinding at 320 grit before 600 and 1200 grits).

The mass deposition efficiency is the ratio of the amount of powder particles that adhere to the substrate versus the amount of powder particles that are sprayed on the substrate. The weight of the substrate and the weight of the powder feeder before and after cold spray are measured. The differences in the weight are then calculated. The ratio of substrate weight increase and the powder feeder weight decrease is reported as deposition efficiency. It should be noted that this measurement of deposition efficiency is conservative in that it does not account for losses of powder to the hoses or powder feeder itself.

Quantitative porosity of the cold spray depositions was evaluated using ASTM standard E2109. Optical micrographs were collected using an optical microscope at a magnification of 500×, both along the longitudinal direction and also through the thickness after metallo graphic sample preparation. The micrographs were consequently thresholded using ImageJ software and quantified as percent by area.

For the WIP C1 $Cr_3C_2$—NiCr cold spray deposition, optical micrographs at a magnification of 200× along the raster direction and through the thickness were collected. They were subsequently thresholded using ImageJ and quantified as percent by area. Although this does not follow ASTM standard E2109, this procedure is frequently employed in the cold spray literature as well.

Multiple fields of view (three in number for most cases) at a magnification of 500× were collected at the junction between substrate and coating. Each micrograph was carefully analyzed to identify presence of embedded grit/second phase particles and porosity along the juncture. Absence of either in a coating was reported as "coating with good interface quality/adhesion."

Microhardness testing was performed on an automatic Vickers microhardness tester manufactured by Clemex, by performing 15-18 indents across the longitudinal direction and also through the thickness of the cold spray deposition.

The steel member used in the following examples included 4xxx-series chromium plated steel. Table 1 below illustrates a summary of the powders sprayed onto the steel member for the examples.

TABLE 1

| | Provider | Product Name | Composition | Powder size |
|---|---|---|---|---|
| Discarded | Praxair | CRC 410-1 | $Cr_3C_2$-30NiCr | −45 μm/+11 μm |
| | Praxair | CRC 425 | $Cr_3C_2$-40NiCr | −53 μm/+16 μm |
| | Praxair | 1375VF | $Cr_3C_2$-25NiCr | −38 μm/+10 μm |
| | Suzer Metco | Diamalloy 3004 | $Cr_3C_2$-25NiCr | −45 μm/+25 μm |
| | | | | −25 μm/+20 μm |

TABLE 1-continued

| | Provider | Product Name | Composition | Powder size |
|---|---|---|---|---|
| | | | | −20 μm/+5 μm |
| | | | | −25 μm/+5 μm |
| | H.C. Starck | Amperit 584 | $Cr_3C_2$-35NiCr | −30 μm/+5 μm |
| Selected | H.C. Starck | Amperit 587.090 | $Cr_3C_2$-35NiCr | −30 μm/+5 μm |

Table 2 below outlines the spray parameters for the selected powder.

TABLE 2

| Parameter Selection | Value |
|---|---|
| Powder | HC. Starck Amperit 587.090 |
| Gas Temperature | 932 F. (500° C.) |
| Gas Pressure | 500 psi (3.44 MPa) |
| Gas Nature | Nitrogen |
| Powder Preheating | RT |
| Standoff Distance | 0.4 inch (10 mm) |
| Traverse Speed | 0.2 in/s (5 mm/s) |
| Step Size | 40 thou (2 mm) |
| N° of Cycle | 3 |
| Feed Rate | 5 rpm |
| Feed Wheel Type | 240 hole |
| Powder Feeder Gas Flow Rate | 25 SCFH |
| Powder Feeder Gas Nature | Nitrogen |
| Nozzle Type | UltiLife Nozzle |
| Orifice Diameter | 79 thou (2 mm) |

Figure 2:
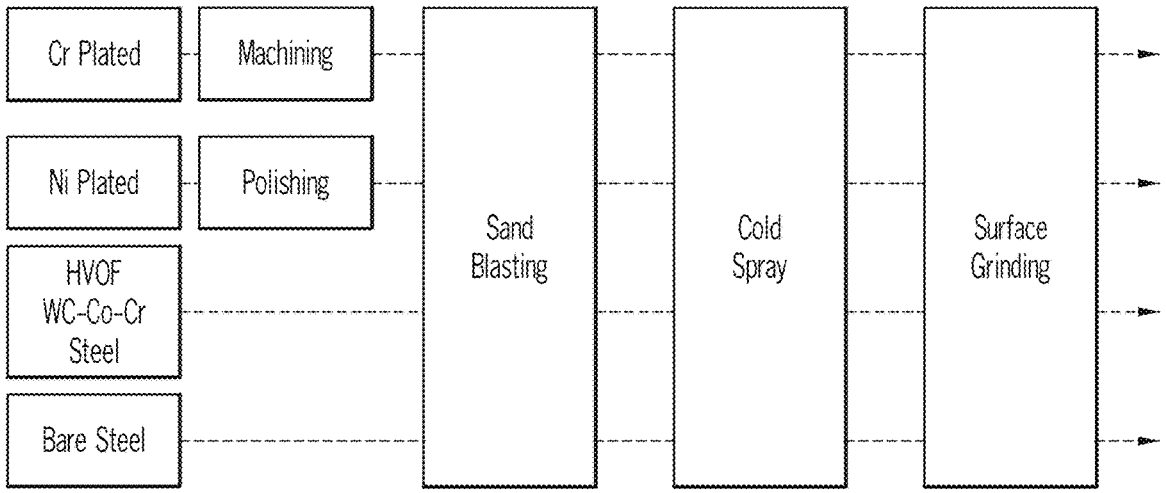
FIG. 2 is a flowchart of processing steps for the method of FIG. 1.
Figure 3:
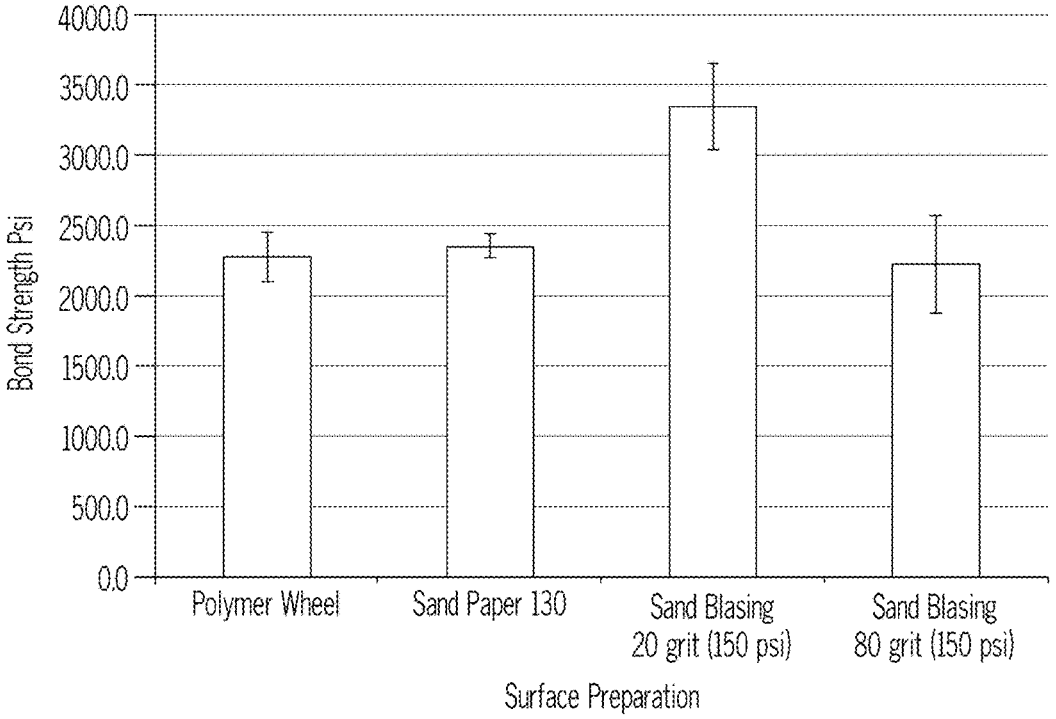
FIG. 3 is a graph of material properties of various examples of the method of FIG. 1.
Figure 4:
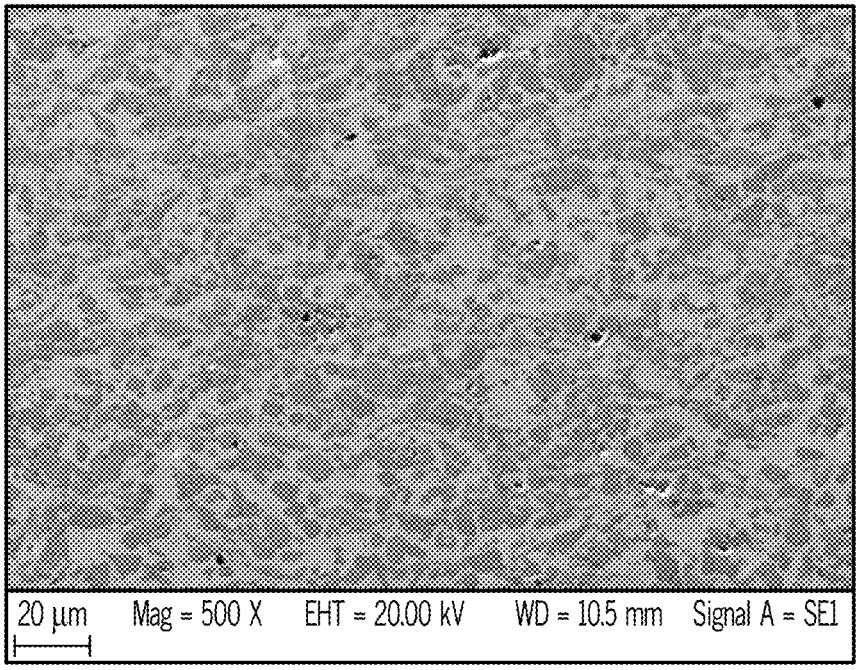
FIG. 4 is a micrograph of an exemplary repair coating.

During testing, various procedures for substrate preparation were analyzed in order to obtain optimal interface between the pre-existing damaged coating and the repair coating. Substrate preparation varied depending on the composition of the substrate. Substrate preparation steps are illustrated in FIG. 2 of the drawings. The sand blasting process selected resulted in the highest adhesion strength (ASTM 633C), as illustrated in FIG. 3 of the drawings showing examples of surface preparations. Sand blasting yielded the largest surface roughness, thus promoting more mechanical anchoring sites for mechanical adhesion. FIG. 4 illustrates a micrograph of the repair coating obtained with the selected cold spray parameters.

Figure 5:
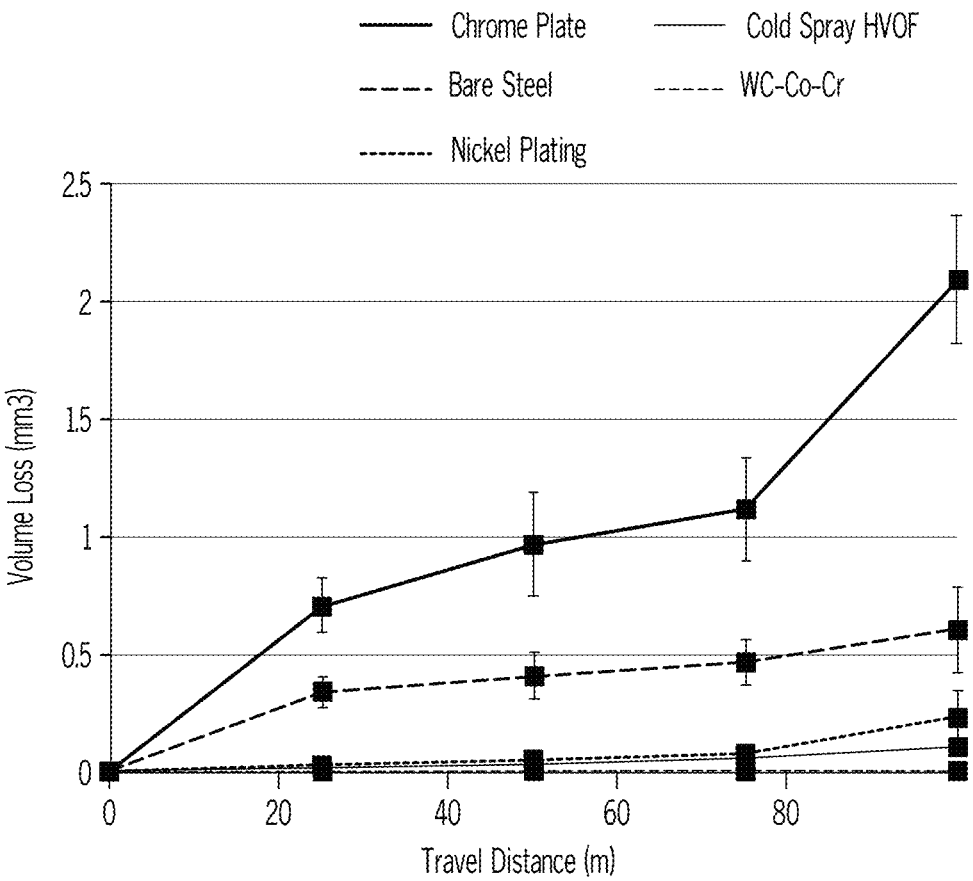
FIG. 5 is a graph of wear test results of base materials after application of exemplary repair coatings.

A comparative wear test was completed with the pre-existing coatings and base material, as well as the cold spray repair coating. The standard ASTM G133-05 was followed. Four total lengths were tested and the loss in volume was computed with 3D imaging by depth composition. The results are illustrated in FIG. 5, which is a graph of volume loss ($mm^3$) as a function of travel distance (m).

Table 3 below illustrates the qualification plan steps followed for each substrate type (bare steel, high velocity oxygen fuel (HVOF) coated steel, nickel plated steel, and chrome plated steel), with the exception of fatigue and hydrogen embrittlement tests.

TABLE 3

| Test | Quantity | Total | Specification | Specimen Size/ Type | Thickness |
|---|---|---|---|---|---|
| Hydrogen Embrittlement on Bare Steel | 8 | 8 | ASTM F 519 | Ty 1a.1 bar | 3 mils |

TABLE 3-continued

| Test | Quantity | Total | Specification | Specimen Size/ Type | Thickness |
|---|---|---|---|---|---|
| Adhesion & Metallurgy On Bare steel and repaired Cr, Ni and HVOF | 3 ea | 24 | DPS 9.89 | 1 × 6 × .25 | 3 & 10 mils |
| Fatigue on bare steel | 12 | 12 | ASTM E 466 | Round 0.5 dia (gage) | 3 & 10 mils |
| Corrosion on bare steel and on repaired Cr, Ni and HVOF. | 3 ea | 12 | ASTM B 117 | 4 × 6 × .25 | 3 mils |
| Fluid Immersion on bare steel and on repaired Cr, Ni and HVOF. | 7 ea | 28 | ASTM F 483 Mod | 1 × 6 × .25 | 3 mils |

Coating porosity level and surface roughness as well as micro-hardness of base materials and repairs were measured. Coatings were required to meet the standard DPS 9.89 or MIL-STD-865C. These tests were performed on 1 in by 6 in by 0.25 in samples of bare steel and damaged materials (chrome plated steel, HVOF coated steel, and nickel plated steel). Strip rupture testing (bend to break) was performed and samples were inspected for evidence of peeling and flaking of the coating. Each specimen was photographed before, during, and after the test. To facilitate the bending process on 0.25 in steel, a V-notch was machined on the back using EDM (up to 40 mils from the coating interface).

The substrates for 3 mils repair were sprayed and prepared for the test. A summary of the results can be found in Table 4 below. The results for this table were taken from three cross-sections of three different samples.

TABLE 4

| Substrate | Hardness | Porosity | Adhesion |
|---|---|---|---|
| Bare Steel | 656 ± 82 | <1% | Pass |
| Ni-Plated | 682 ± 118 | <1% | Pass |
| HVOF WC-Co-Cr | 653 ± 116 | <1% | Pass |
| Cr-Plated | 662 ± 108 | <1% | Pass |

Figure 6A:
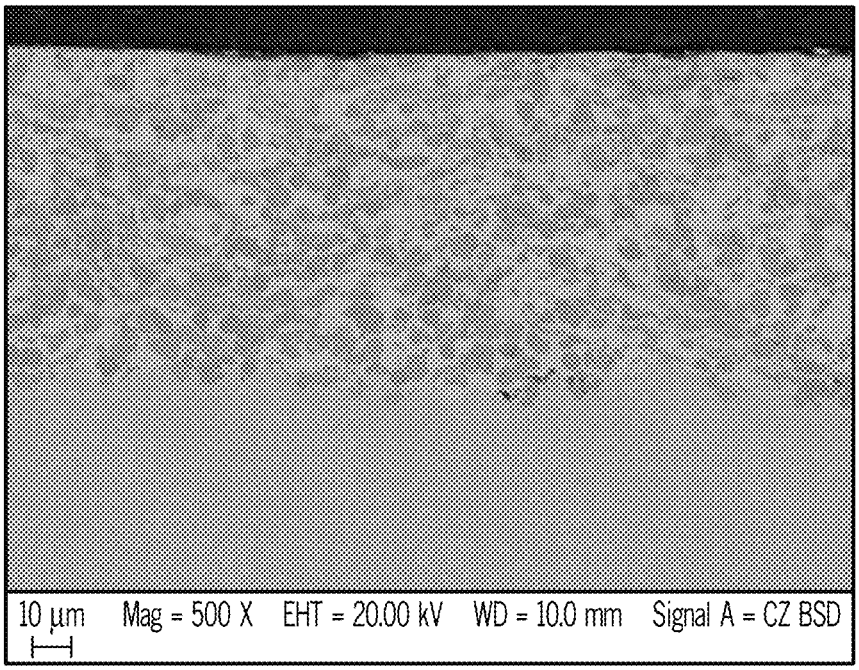
FIG. 6*a* is a cross sectional micrograph of a repair coating on bare steel.
Figure 6B:
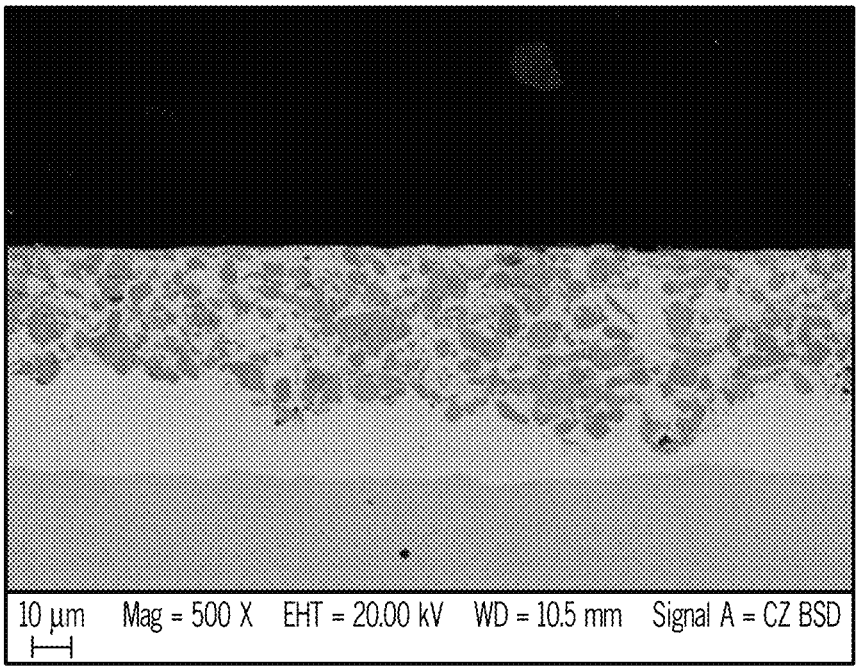
FIG. 6*b* is a cross sectional micrograph of a repair coating on nickel plated steel.
Figure 6C:
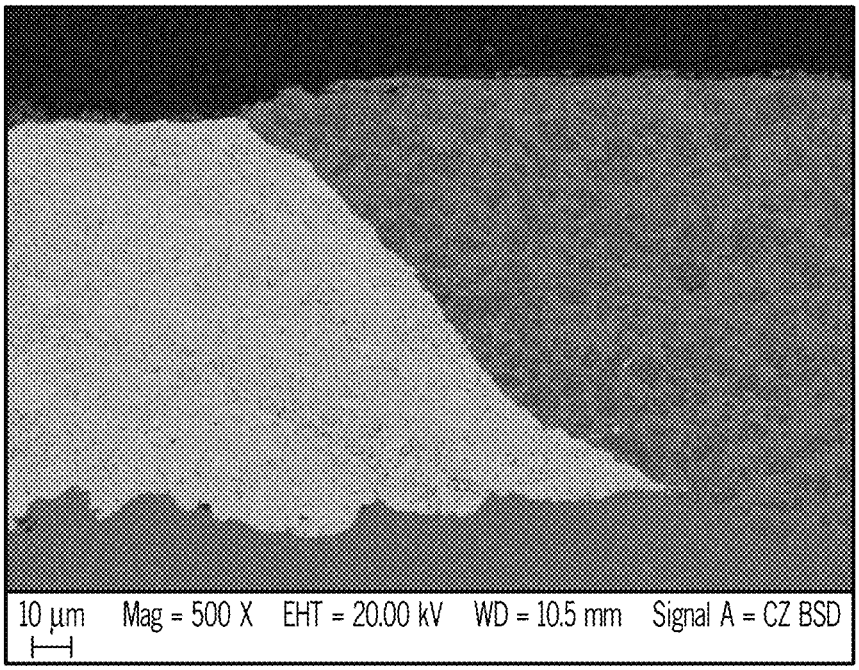
FIG. 6*c* is a cross sectional micrograph of a repair coating on high velocity oxygen fuel plated steel.
Figure 6D:
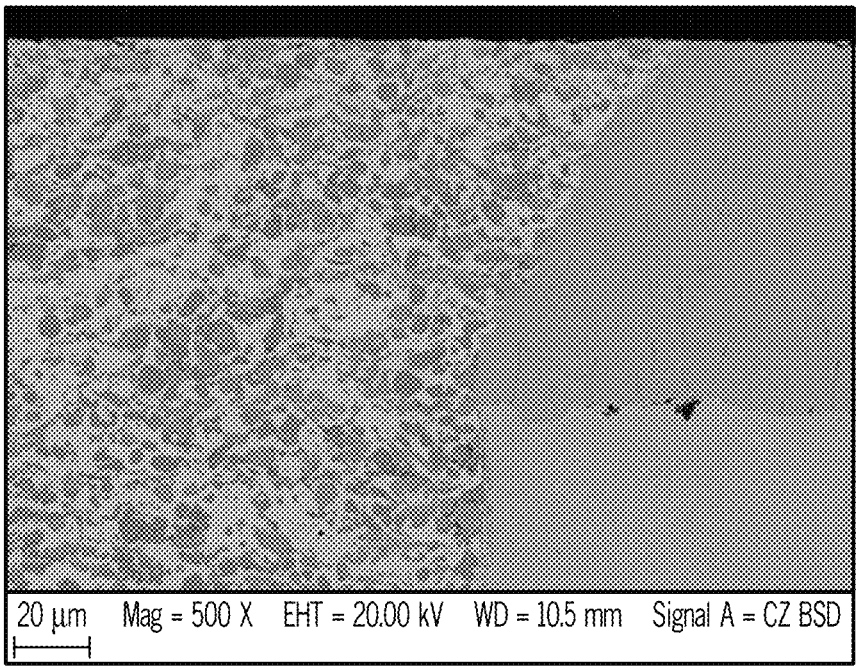
FIG. 6*d* is a cross sectional micrograph of a repair coating on chrome plated steel.
Figure 7A:
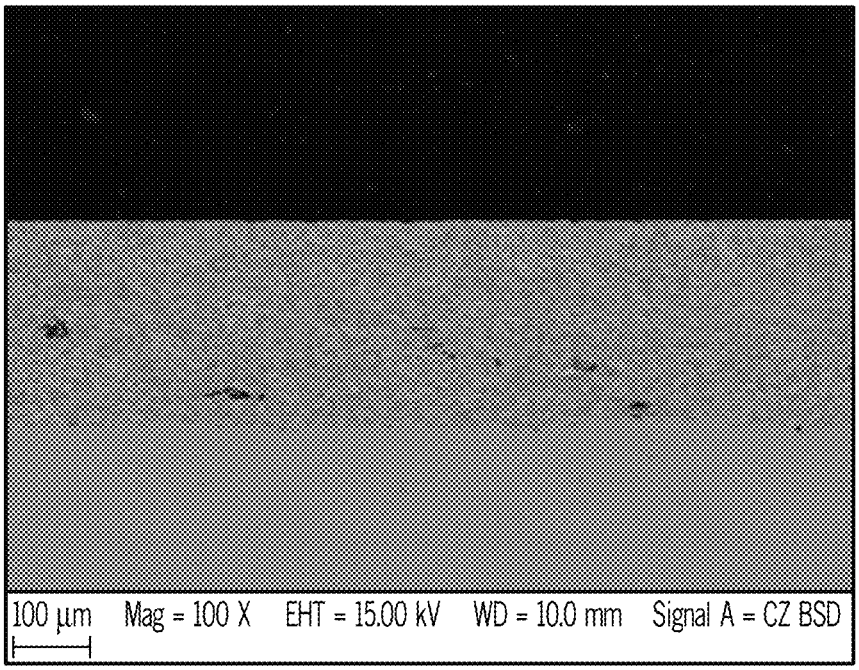
FIG. 7*a* cross sectional micrograph of a repair coating on bare steel.
Figure 7B:
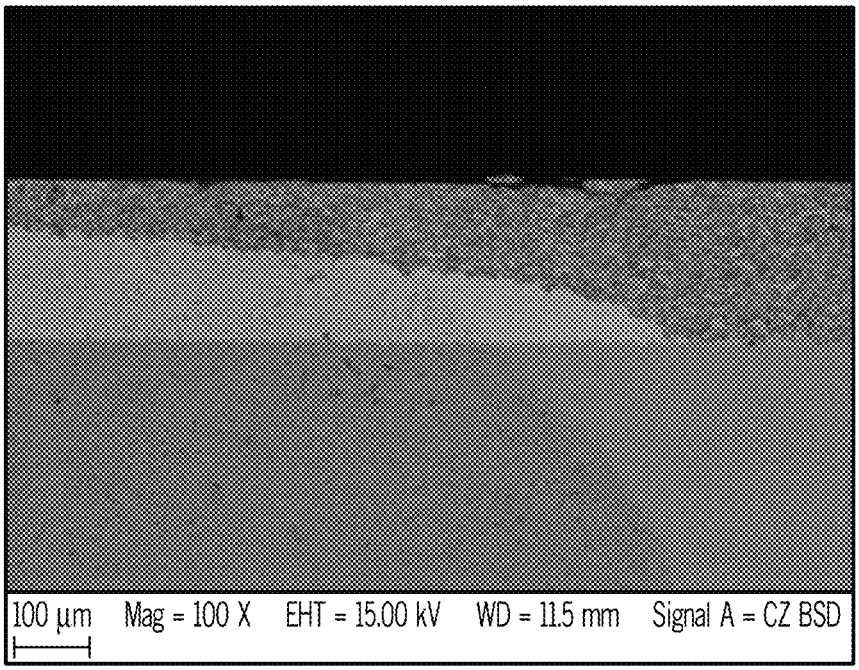
FIG. 7*b* is a cross sectional micrograph of a repair coating on nickel plated steel.
Figure 7C:
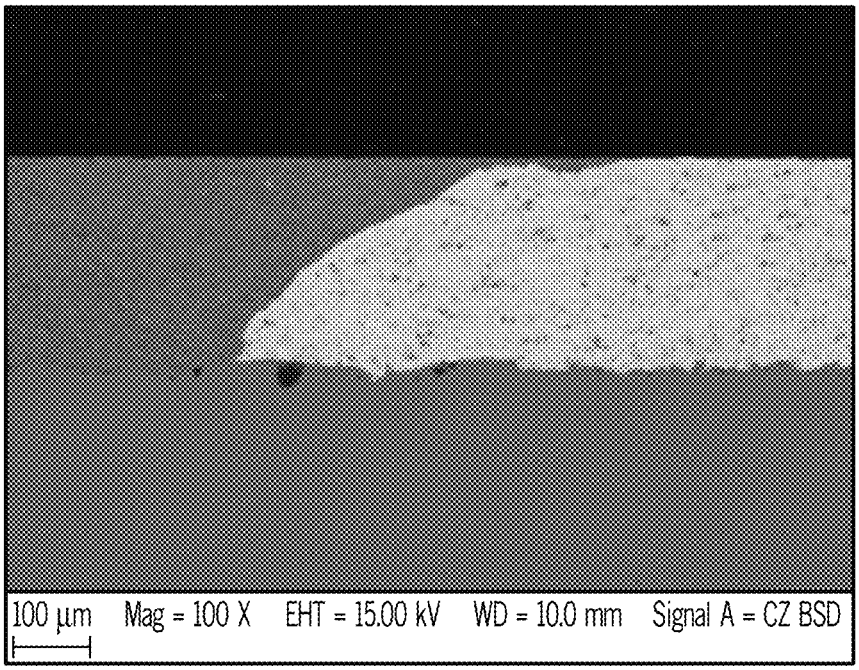
FIG. 7*c* is a cross sectional micrograph of a repair coating on high velocity oxygen fuel plated steel.
Figure 7D:
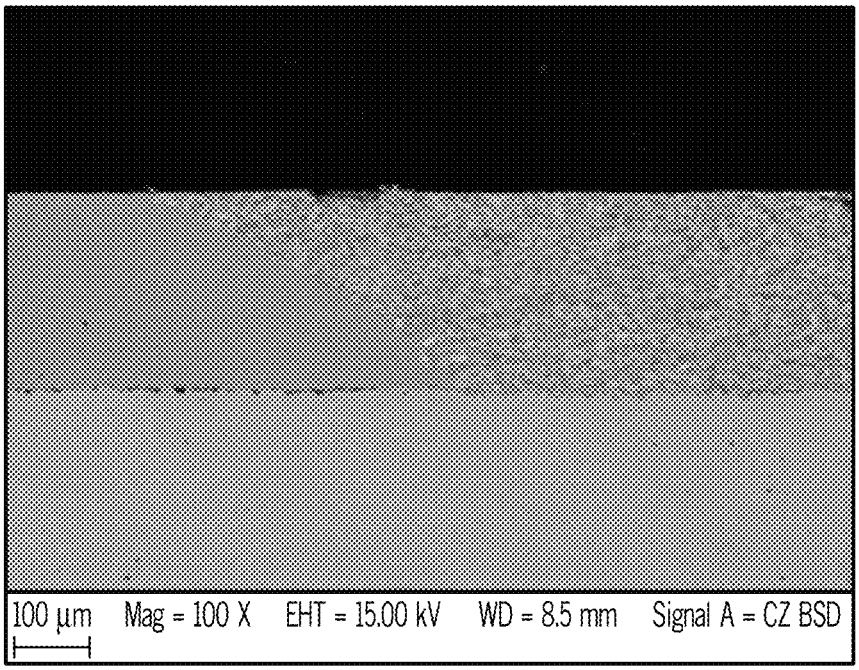
FIG. 7*d* is a cross sectional micrograph of a repair coating on chrome plated steel.

FIGS. 6*a*-6*d* are cross-sectional micrographs for each metallic substrate tested. It is possible to observe the intimate contact between the cold spray coating and the substrate. The images also show the density of the coating as well as the interface with the pre-existing coating. FIG. 6*a* is bare steel, FIG. 6*b* is Ni-plated, FIG. 6*c* is HVOF WC—Co—Cr, and FIG. 6*d* is Cr-plated steel. In order to measure the coating adhesion, strip rupture testing was performed for three samples per each type of substrate sprayed.

Substrates for 10 mil repairs were sprayed and prepared for testing. A summary of the results is illustrated in Table 5 below. The results for this table were taken from three cross-sections of three different samples (unless noted).

TABLE 5

| Substrate | Hardness | Porosity | Adhesion |
|---|---|---|---|
| Bare Steel | 784 ± 83 | <1% | Pass |
| Ni-Plated | 719 ± 119* | <1% | Pass |

TABLE 5-continued

| Substrate | Hardness | Porosity | Adhesion |
|---|---|---|---|
| HVOF WC-Co-Cr | 799 ± 81 | <1% | Pass |
| Cr-Plated | 683 ± 88* | <1% | Pass |

*Values taken from less than three samples

FIG. 7*a*-7*d* are cross-sectional micrographs of the repaired substrates and the interface of the repair coating with the pre-existing coating. Strip rupture testing was performed. All samples passed the test since no delamination was seen in the crack zone and it was not possible to peel the coating off.

Although various examples of the disclosed repair coatings and methods for repairing a damaged portion of a steel member that includes at least one of a coating and a plating have been shown and described, modifications may occur to those skilled in the art upon reading the specification. The present application includes such modifications and is limited only by the scope of the claims.

What is claimed is:

1. A method for repairing a damaged portion of a pre-existing coating on a steel member, the method comprising:

pretreating the damaged portion of the pre-existing coating on the steel member with an abrasive media to prepare for the repairing;

applying a coating composition to the damaged portion of the pre-existing coating on the steel member to produce a repair coating to repair the damaged portion, the repair coating interfacing with an undamaged portion of the pre-existing coating on the steel member, the coating composition comprising nickel, chromium, and carbon.

2. The method of claim 1, wherein the coating composition comprises CrC—NiCr with a weight distribution of about 75 percent CrC and about 25 percent NiCr.

3. The method of claim 1, wherein the coating composition comprises CrC—Ni.

4. The method of claim 1, wherein the applying comprises cold spraying the coating composition over the damaged portion of the steel member with a carrier gas at a temperature of approximately 400° C. to approximately 800° C., and wherein the carrier gas comprises at least one of nitrogen, helium, and a combination thereof.

5. The method of claim 1, wherein the applying is performed at a stagnation gas pressure of approximately 300 psi to approximately 700 psi.

6. The method of claim 1, further comprising grinding the repair coating on the steel member after the applying to interface the repair coating with the undamaged portion of the pre-existing coating.

7. The method of claim 1, wherein the pre-existing coating on the steel member comprises a high velocity oxygen fuel coating.

8. The method of claim 1, wherein the repair coating has a nominal cross-sectional thickness ranging from about 1 mil to about 15 mils.

9. The method of claim 1, wherein the pretreating comprises sandblasting or grit blasting the damaged portion of the pre-existing coating on the steel member.

10. The method of claim 1, wherein the pretreating comprises grinding the damaged portion of the pre-existing coating on the steel member.

11. The method of claim 1, wherein the coating composition comprises a powder, and wherein the applying comprises applying the powder to the damaged portion of the steel member at a powder feed rate of approximately 5 g/min to approximately 25 g/min.

12. A method for repairing a damaged portion of a pre-existing plating on a steel member, the method comprising:

applying a coating composition to the damaged portion of the pre-existing plating on the steel member to produce a repair coating to repair the damaged portion, the repair coating interfacing with an undamaged portion of the pre-existing plating on the steel member, the coating composition comprising nickel, chromium, and carbon; and grinding the repair coating on the steel member to interface the repair coating with the undamaged portion of the pre-existing plating.

13. The method of claim 12, wherein the coating composition comprises CrC—NiCr with a weight distribution of about 75 percent CrC and about 25 percent NiCr.

14. The method of claim 12, wherein the coating composition comprises a powder, and wherein the applying comprises applying the powder at a powder feed rate of approximately 5 g/min to approximately 25 g/min.

15. The method of claim 12, wherein the applying comprises cold spraying the coating composition with a carrier gas at a temperature of approximately 400° C. to approximately 800° C., and wherein the carrier gas comprises at least one of nitrogen, helium, and a combination thereof.

16. The method of claim 12, wherein the applying is performed at a stagnation gas pressure of approximately 300 psi to approximately 700 psi.

17. The method of claim 12, wherein the pre-existing plating on the steel member is one of a nickel plating and a chrome plating.

18. The method of claim 12, further comprising pretreating the damaged portion of the pre-existing plating on the steel member with an abrasive media to prepare for the repairing prior to the applying.

19. The method of claim 12, wherein the repair coating has a nominal cross-sectional thickness ranging from about 1 mil to about 15 mils.

20. The method of claim 12, wherein the grinding comprises grinding the repair coating on the steel member at one or more of 320 grit, 600 grit and 1200 grit.

* * * * *